252-99 AU 166 EX
1/6/81 XR 4,243,544

United States Patent [19]
Taylor
[11] 4,243,544
[45] Jan. 6, 1981

[54] PRODUCTION OF ALUMINO-SILICATE-CONTAINING DETERGENT COMPOSITION

[75] Inventor: Thomas Taylor, Northwich, England

[73] Assignee: Lever Brothers Company, New York, N.Y.

[21] Appl. No.: 7,062

[22] Filed: Jan. 29, 1979

[30] Foreign Application Priority Data

Feb. 1, 1978 [GB] United Kingdom ..... 4052/78

[51] Int. Cl.[3] ..... C11D 7/02; C11D 7/14; C11D 11/02

[52] U.S. Cl. ..... 252/135; 252/99; 252/174.25

[58] Field of Search ..... 252/99, 135, 174.25, 252/131, 140

[56] References Cited

U.S. PATENT DOCUMENTS

| | | | |
|---|---|---|---|
| 4,000,094 | 12/1976 | Fleming et al. | 252/557 |
| 4,019,999 | 4/1977 | Ohren et al. | 252/140 |
| 4,092,261 | 5/1978 | Sperling et al. | 252/131 |
| 4,129,511 | 12/1978 | Ogoshi et al. | 252/140 |

*Primary Examiner*—P. E. Willis, Jr.

[57] ABSTRACT

Spray dried detergent compositions which incorporate a sodium aluminosilicate detergency builder, are prepared by forming an aqueous detergent slurry containing the sodium aluminosilicate and then admixing an aqueous solution or suspension of sodium silicate with the detergent slurry at a point between the slurry mixing vessel and the spray nozzle. This avoids harmful interaction between the sodium aluminosilicate and the sodium silicate, which otherwise decreases washing performance, while retaining good powder properties.

13 Claims, No Drawings

PRODUCTION OF ALUMINO-SILICATE-CONTAINING DETERGENT COMPOSITION

This invention relates to the production of detergent compositions in powder form, particularly such compositions which are suitable for fabric washing, and which are made by conventional slurry making and spray drying techniques.

In addition to the well known detergent active compounds and detergency builders which are commonly incorporated in fabric washing compositions, it is very common practice to add to them an amount of sodium silicate, which acts primarily as a corrosion inhibitor and alkaline pH buffer. Sodium silicate can also to some extent counteract the adverse effects of magnesium ions present in wash liquors and in particular acts as a structuring agent to improve powder properties. For these reasons, an amount of sodium silicate, commonly in the range of about 5% to 15%, is found in most detergent compositions.

However, it has been found that the benefits of having sodium silicate present are sometimes accompanied by harmful interaction between the sodium silicate and other detergent ingredients. This occurs in particular with detergent compositions which also contain a sodium aluminosilicate detergency builder, and the present invention seeks to provide a new way of including sodium silicate in such detergent compositions.

According to the present invention a process for preparing a powdered detergent composition comprises the step of forming a detergent slurry containing a sodium aluminosilicate detergency builder in a slurry mixing vessel and spray drying the slurry through a spray nozzle, wherein an aqueous solution or suspension of sodium silicate is admixed with the detergent slurry at a point between the slurry mixing vessel and the spray nozzle. The invention includes a detergent composition made by such a process.

By using the process of this invention, the contact time between the sodium silicate and the sodium aluminosilicate is decreased substantially compared with conventional processing, without losing the benefits of sodium silicate addition. The same benefits cannot be achieved merely by adding powdered sodium silicate to detergent compositions, as the sodium silicate cannot then act as a detergent powder structuring agent, besides which the sodium silicate is commonly of different density from the detergent powder which can give rise to segregation problems.

The amount of sodium silicate used in the process of the invention can vary widely according to the type of composition involved, that is from a minimum of about 0.1% up to about 50% by weight of the resultant detergent composition. Normally, however, amounts in the range of from about 0.5% to about 20%, especially about 1% to about 15%, are used for conventional purposes, that is for corrosion inhibition, pH buffer control and powder structuring properties. Amounts of sodium silicate in excess of this up to about 40% are sometimes used for supplementary detergency building properties in fabric washing compositions. Still higher levels of sodium silicate can be present in other types of powdered detergent compositions, for example for dishwashing or industrial purposes in which high alkalinity is usual.

It will be appreciated that in addition to the sodium silicate added by the process of the invention, it is possible to include some more sodium silicate in the detergent slurry itself, especially to inhibit corrosion in the slurry making equipment, but normally it will not be more than about 5%, especially not more than about 2%, by weight of the resultant composition unless particularly high total levels of the sodium silicate are desired.

Any normal type of sodium silicate can be used, preferably with a sodium oxide to silica ratio of from about 2:1 to about 1:4, for example sodium alkaline silicate ($Na_2O.2SiO_2$), sodium neutral silicate ($Na_2O.3.3SiO_2$), sodium metasilicate ($Na_2O.SiO_2$) or sodium orthosilicate ($2Na_2O.SiO_2$), or mixtures thereof, the less alkaline silicates ($Na_2O.1-4SiO_2$) being preferred. Suitable sodium silicates are available in aqueous solutions direct from the manufacturers, and they can be used directly in the process of the present invention. Aqueous sodium silicate suspensions can also be used where convenient, to give further decreased ionic interaction in the detergent slurry. The sodium silicate solutions or suspensions generally have a concentration of from about 10% to about 70% by weight, preferably about 20% to about 50%, as in most commercially available products.

The sodium aluminosilicate used in the process and compositions of the invention can be either amorphous or crystalline or mixtures thereof, and they have the general formula: $0.8-1.5Na_2O.Al_2O_3.O.8-6SiO_2$. These materials contain some bound water and are required to have a calcium ion-exchange capacity of at least about 50 mg CaO/g. The preferred sodium aluminosilicates contain 1.5–3.5 $SiO_2$ units (in the formula above), and have a particle size of not more than about 100μ, preferably not more than about 20μ. Both the amorphous and crystalline sodium aluminosilicates can be made readily by reaction between sodium silicate and sodium aluminate in aqueous solution, as amply described in the literature.

Suitable amorphous sodium aluminosilicates for detergency building use are described for example in UK Pat. No. 1,473,202. It appears that sodium silicate interacts with the amorphous sodium aluminosilicate particles to inhibit the calcium ion-exchange properties of the latter in a manner which has not yet been explained. Use of the process of the invention for making detergent compositions containing such sodium aluminosilicates helps particularly to increase their rate of calcium ion-exchange, which is an important benefit in the detergent process.

Alternatively, suitable crystalline sodium aluminosilicate ion-exchange detergency builders are described in UK Pat. Nos. 1,473,201 and 1,429,143. The preferred sodium aluminosilicates of this type are the well known commercially available zeolites A and X, and mixtures thereof. The ion-exchange properties of the crystalline aluminosilicates are not seriously affected by contact with sodium silicate, but the latter appears to promote aggregation of the sodium aluminosilicate particles which is seen by the consumer as decreased solubility of the compositions and sometimes deposition on the washed fabrics.

It has been proposed hitherto to add sodium silicate to detergent compositions other than by incorporation into a detergent slurry, for example by spraying preformed sodium silicate in powder form directly into the spray drying tower adjacent to the slurry spray nozzle, so that the detergent slurry coats the silicate particles.

But in such processes the sodium silicate cannot have its full beneficial effect on powder properties as it is not homogeneously mixed with the other ingredients in the particles. In addition, it is difficult to control such combined spraying processes, especially during start-up and shut-down.

Other conventional ingredients may be incorporated into the detergent compositions made by the process of the present invention, especially detergent surfactants which may be anionic, nonionic, amphoteric or zwitterionic in nature and are generally present at levels between about 2% and about 60% by weight, especially about 5% to about 40% by weight of the compositions. The ratio of the total amount of detergent compounds to the total of the amount of builders should generally be in the range of from about 5:1 to about 1:10, especially about 1:1 to about 1:5, parts by weight.

Suitable detergent surfactants are well known and readily available, as described for example in "Surface Active Agents and Detergents," Volumes I and II by Schwartz, Perry & Berch.

Synthetic anionic detergent compounds which can be used are usually water soluble alkali metal salts of organic sulphates and sulphonates having alkyl radicals containing from about 8 to 22 carbon atoms, the term alkyl being used to include the alkyl portion of higher acyl radicals. Examples of suitable synthetic anionic detergent compounds are sodium and potassium alkyl sulphates, especially those obtained by sulphating the higher ($C_8$–$C_{18}$) alcohols produced by reducing the glycerides of tallow or coconut oil; sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty acid monoglyceride sulphates and sulphonates; sodium and potassium salts of sulphuric acid esters of higher ($C_9$–$C_{18}$) fatty alcohol-alkylene oxide, particularly ethylene oxide, reaction products; the reaction of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived by reacting paraffins with $SO_2$ and $Cl_2$ and then hydrolysing with a base to produce a random sulphonate; and olefin sulphonates, which term is used to describe the material made by reacting olefins, particularly alphaolefins, with $SO_3$ and then neutralizing and hydrolysing the reaction product.

Nonionic detergent active compounds may alternatively or additionally be used. Examples of nonionic detergent active compounds include the reaction products of alkylene oxides, usually ethylene oxide, with alkyl ($C_6$–$C_{22}$) phenols, generally 5 to 25 EO; ie. 5 to 25 units of ethylene oxide per molecule; the condensation products of aliphatic ($C_8$–$C_{18}$) primary or secondary alcohols with ethylene oxide, generally 6 to 30 EO, and products made by condensation of ethylene oxide with the reaction products of propylene oxide and ethylenediamine. Other so-called nonionic detergent active compounds include long chain tertiary amine oxides, long chain tertiary phosphine oxides and dialkyl sulphoxides, which are properly semi-polar compounds.

Mixtures of detergent active compounds, for example mixed anionic or mixed anionic and nonionic compounds, may be used in the detergent compositions, particularly to impart thereto controlled low sudsing properties. This is beneficial for compositions intended for use in suds-intolerant automatic washing machines.

Amounts of amphoteric or zwitterionic detergent active compounds can also be used in the compositions of the invention but this is not normally desired due to their relatively high cost. If any amphoteric or zwitterionic detergent active compounds are used, especially sulphobetaines such as hexadecyl dimethyl ammoniopropane sulphonate, it is generally in small amounts in compositions based on the much more commonly used anionic and/or nonionic detergent active compounds.

Some soap can also be present in the compositions, especially in low sudsing compositions together with mixed synthetic and nonionic detergent compounds. Such soaps are the sodium, or less desirably potassium, salts of $C_{12}$–$C_{22}$ fatty acids, especially natural fatty acids derived from nut oils, such as coconut oil or palm kernel oil, or preferably tallow class fats, such as beef and mutton tallows, palm oil, lard, some vegetable butters and castor oil, or mixtures thereof. Mixtures are preferred of tallow class soaps, which are soaps of predominantly $C_{14}$–$C_{20}$ (mainly $C_{18}$) fatty acids of which normally at least about 40% are saturated fatty acids, with soaps from nut oils, which are soaps of predominantly $C_{10}$–$C_{14}$ (mainly $C_{12}$) fatty acids, of which normally at least about 75% are saturated fatty acids. The amount of soap can be varied widely from about 0.5% to about 20% by weight of the composition, but is normally from about 1% to about 5% if present for lather control purposes. Higher amounts of soap can be used as a supplementary detergent active compound, but the amount of soap is not to be included in the amount of the synthetic detergent active compound, whether it is prepared from natural or synthetic fatty acids.

The detergent compositions made according to the invention can contain any of the conventional additives in the amounts in which such additives are normally employed in fabric washing detergent compositions. Examples of these additives include lather boosters such as alkanolamides, particularly the monoethanolamides derived from palm kernel fatty acids and coconut fatty acids, powder flow aids such as finely divided silicas and other aluminosilicates, lather depressants, antiredeposition agents such as sodium carboxymethylcellulose, oxygen-releasing bleaching agents such as sodium perborate and sodium percarbonate, per-acid bleach precursors, chlorine-releasing bleaching agents such as trichloroisocyanuric acid and alkali metal salts of dichloroisocyanuric acid, fabric softening agents such as clays of the smectite and illite types, anti-ashing aids, starches, soap scum dispersants, inorganic salts such as sodium sulphate, and usually present in very minor amounts, fluorescent agents, perfumes, enzymes such as proteases and amylases, germicides and colourants. In addition, especially in the case of nonionic-based detergent compositions, it may be desirable to add slurry stabilisers such as copolyethylene-maleic anhydride and copolyvinylmethylether-maleic anhydride, usually in salt form.

Besides the essential sodium aluminosilicate detergency builders which have been mentioned above, other conventional detergency builders may be present such as sodium tripolyphosphate, sodium pyrophosphate, sodium orthophosphate, sodium carboxymethyloxysuccinate, sodium nitrilotriacetate and sodium carbonate.

The slurry making and spray drying steps in the process of the present invention may be accomplished using conventional equipment for this purpose, for example in crutcher, paddle or turbo mixers and spray drying towers. Normal temperatures may be used for these operations, for example from about 30° C. to about 100° C., preferably about 70° C. to 90° C. for the slurry making and about 200° C. to 450° C. for the drying gas inlet in the spray drying process, with higher temperatures within this range being generally preferred for economic reasons.

The aqueous sodium silicate solution or suspension is admixed with the detergent slurry using either poor (i.e. inefficient) or efficient mixing as desired, and the point of admixture can also be varied at any position between the slurry mixing vessel and the spray nozzle. It is preferred to have the slurry and sodium silicate in contact for only a short time, for example less than about 5 minutes, preferably less than about 1 minute, whereas contact times in conventional processing can be 20 minutes or more. In the process of the invention, efficient mixing of the slurry and sodium silicate can generally be tolerated, and indeed is preferred for better powder properties. Thus an in-line static mixer is conveniently used, eg with a swirl-chamber design. Alternatively, if the minimum possible contact between the detergent slurry and sodium silicate is required, it is possible to mix them together adjacent to or in the spray nozzle itself, especially where swirl jets are used.

In addition to delaying admixture of the sodium silicate and the detergent slurry in accordance with the invention, it appears that overdrying the detergent powders during spray drying can also be deleterious, and encourage interaction between the sodium silicate and other detergent ingredients. Thus, to achieve the best results, it has been found preferential to avoid overdrying, and in particular, it is preferred to have a residual water content in the detergent powders of at least about 10% and preferably about 12% to about 20% by weight. This is particularly beneficial in the case of detergent powders containing amorphous sodium aluminosilicate as the detergency builder.

After the spray drying step, the detergent powder may be further dried if desired, for example in a fluidised bed, after which it may have added to it other detergent ingredients, particularly such ingredients which are heat-sensitive and cannot be readily added to the slurry without degrading or being otherwise deleteriously affected in the spray drying process, for example oxygen bleaching agents such as sodium perborate and sodium percarbonate, enzymes and perfumes.

The process of the present invention is illustrated by the following Examples in which parts and percentages are by weight except where otherwise indicated.

EXAMPLE 1

A detergent slurry was made up by admixture of all the ingredients (except sodium silicate and sodium perborate) in water and the slurry was then spray dried. A solution of sodium silicate was metered into the high pressure line between the slurry mixing vessel and the spray nozzles using an in-line mixer such that the contact time between the sodium silicate and the detergent slurry was less than 30 seconds. Particulate sodium perborate was then added to the blown powder.

The resultant detergent powder had the following formulation and the spray drying conditions were as shown below:

| Ingredient | % |
|---|---|
| Sodium alkyl benzene sulphonate | 7.0 |
| Ethoxylated nonionic compound | 4.0 |
| Soap | 2.0 |
| Sodium tripolyphosphate | 18.0 |
| Sodium aluminosilicate (amorphous) | 28.0 |
| Sodium carbonate | 2.0 |
| Sodium silicate ($Na_2O:1.6SiO_2$) (injected) | 2.0 |
| Sodium sulphate | 5.0 |
| Sodium carboxymethylcellulose | 1.0 |
| EDTA and fluorescers | 0.4 |
| Water | 9.0 |
| Sodium perborate (added after spray drying) | 25.2 |
| Slurry temperature | 80° C. |
| Slurry water content | 55.1% |
| Air inlet temperature | 350° C. |
| Air outlet temperature (average) | 120° C. |
| Spray nozzle pressure (average) | 43 atmospheres |
| Slurry flow rate (average) | 12.8 kg/min |
| Silicate flow rate | 0.49 kg/min |
| Powder moisture content (average) (includes free water and water of crystallisation) | 16.5% |
| Powder bulk density | 0.41 kg/l |

This detergent powder was tested for water softening properties, when it was found that the sodium aluminosilicate still had a good ion-exchange capacity. In particular, when the sodium aluminosilicate was isolated from the detergent powder, it was found to be still capable of softening 30°H water at 50° C. to less than 1°H in under 1 minute, which showed a retention of over 97.5% of its original ion-exchange capacity. When a detergent powder was made to the same formulation, but using conventional spray drying techniques, strong deactivation of the sodium aluminosilicate was found to occur to the extent that the water softening properties were inadequate for commercial use.

When the procedure was repeated, but the total water content in the resultant powder was less than 10%, it was found that the water softening properties of the sodium aluminosilicate were still better than with the conventionally produced detergent powder, but not as good as with the original spray drying to 16% water content.

EXAMPLE 2

Two detergent powders were made to the same formulation, as given below. One powder (A) was made by conventional processing with all the ingredients except perborate being included in the slurry and spray dried, the other powder (B) by a process according to the invention in which the sodium silicate was injected into the high pressure main adjacent to the spray nozzle. The resultant base powder had the following nominal formulation (prior to adding perborate and other additives):

| Ingredient | Parts |
|---|---|
| Sodium alkyl benzene sulphonate | 3.5 |
| Sodium tallow alcohol sulphate | 3.5 |
| $C_{14}$—$C_{15}$ alcohol - 11 EO | 2.0 |
| Soap | 4.0 |
| Sodium aluminosilicate (hydrated zeolite A) | 18.0 |
| Sodium carboxymethylcellulose | 0.6 |
| Magnesium silicate | 1.0 |
| EDTA and fluorescers | 0.42 |
| Sodium alkaline silicate | 4.0 |

-continued

| Ingredient | Parts |
|---|---|
| Sodium sulphate | 3.76 |
| Water | 5.0 |

The processing conditions and the properties of the respective powders were as follows:

| | Powder A | Powder B |
|---|---|---|
| Slurry moisture content (% $H_2O$) | 52 | 55 |
| Inlet temperature | 305–335° C. | 295–308° C. |
| Outlet temperature | 110–125° C. | 110–124° C. |
| Powder moisture content (% $H_2O$) | 9.2 | 7.7 |
| Powder Bulk density | 17 | 16 |
| Powder compressibility % | 53 | 47 |
| % insolubles[1] 20° C. | 12.0 | 3.4 |
| " 40° C. | 10.1 | 0.8 |
| " 60° C. | 7.2 | 0.2 |

[1]Measured by stirring 5 g powder in 500 mls water for 2 minutes, then filtering through 120 μ filter and weighing the dried residue.

These show that the resultant detergent powders are generally similar in physical properties, except that on dissolution in water there is much less insoluble matter found in the tests on the detergent composition (B) made according to the invention.

EXAMPLE 3

Four detergent compositions were all made to the same formulation, except in the amount and type of sodium silicate added and in the manner of its addition. The powders all contained 21% (anhydrous) of amorphous sodium aluminosilicate ($Na_2O.Al_2O_3.2.2SiO_2$) as the detergency builder. The process conditions were as follows:

Powder A: no sodium silicate added (extra sodium sulphate used instead).

Powder B: 2% sodium silicate ($Na_2.1.6SiO_2$) added in the slurry.

Powder C: 2% sodium silicate ($Na_2O.1.6SiO_2$) added by injection of solution (25% w/w).

Powder D: 2% sodium silicate ($Na_2O.3SiO_2$) added by injection of solution (19% w/w).

The powders had the following calcium ion-exchange rates (time to soften water of 30°H to 3.3°H and 0.8°H) when used at 0.25% (anhydrous) concentration at 50° C.:

| Powder | (mins) to 3.3° H. | to 0.8° H. |
|---|---|---|
| A | 0.4 | 1.2 |
| B | 8.3 | >10 |
| C | 3.6 | >10 |
| D | 2.7 | 6.8 |

These results show that incorporation of the sodium silicate in the detergent slurry (Powder B) largely inhibits the calcium ion-exchange properties of the sodium aluminosilicate. The injection of sodium silicate (Powders C and D) gives better ion-exchange properties than Powder B, but not as good as omitting the silicate altogether (Powder A). However, it was observed that Powder A had somewhat inferior physical properties compared with Powders B, C and D, in that it was softer and more friable as shown by a marked increase in bulk density during pneumatic conveyance.

What is claimed is:

1. In a process for preparing a powdered detergent composition having an effective amount of a sodium alumino-silicate detergency builder, said process comprising the steps of forming a detergent slurry containing the sodium alumino-silicate detergency builder in a slurry mixing vessel and spray drying the slurry through a spray nozzle, the improvement wherein an aqueous solution or suspension of sodium silicate in an amount sufficient to provide from 0.1 to 50% by weight in the detergent composition is admixed with the detergent slurry at a point between the slurry mixing vessel and the spray nozzle and the contact time between the detergent slurry and the solution or suspension of sodium silicate is less than 5 minutes.

2. A process according to claim 1, wherein the solution or suspension of sodium silicate has a concentration of from about 10% to about 70% by weight.

3. A process according to claim 2, wherein the concentration of the solution or suspension of sodium silicate is from about 20% to about 50% by weight.

4. A process according to claim 1, wherein the amount of sodium silicate used is about 1% to about 15% by weight of the composition.

5. A process according to claim 1, wherein the sodium silicate used has the formula $Na_2O.1–4SiO_2$.

6. A process according to claim 1, wherein the contact time is less than 1 minute.

7. A process according to claim 1, wherein the solution or suspension of sodium silicate is admixed with the detergent slurry adjacent to or in the spray nozzle.

8. A process according to claim 1, wherein the sodium aluminosilicate is an amorphous sodium aluminosilicate having the formula $0.8–1.5Na_2O.Al_2O_3.1.5–3.5SiO_2$.

9. A process according to claim 1, wherein the sodium aluminosilicate is a crystalline sodium aluminosilicate having the formula $0.8–1.5Na_2O.Al_2O_3.1.5–3.5SiO_2$.

10. A process according to claim 9, wherein the sodium aluminosilicate is zeolite A or X or a mixture thereof.

11. A process according to claim 1, wherein the spray dried detergent powder has a residual water content of at least about 10% by weight.

12. A process according to claim 11, wherein the residual water content is from about 12% to about 20% by weight.

13. A detergent composition made by a process according to claim 1.

* * * * *